United States Patent [19]

Hobbs et al.

[11] Patent Number: 4,615,476

[45] Date of Patent: Oct. 7, 1986

[54] FLUID-DISPENSING APPARATUS

[75] Inventors: Richard E. Hobbs, Huntington, Ind.; John H. Hanning, West Chester, Ohio

[73] Assignee: Huntington Laboratories, Inc., Huntington, Ind.

[21] Appl. No.: 616,946

[22] Filed: Jun. 4, 1984

Related U.S. Application Data

[63] Continuation-in-part of Ser. No. 402,166, Jul. 26, 1982, abandoned.

[51] Int. Cl.[4] ..... B67B 5/00

[52] U.S. Cl. ..... 222/153; 222/156; 222/179; 222/180; 222/182

[58] Field of Search ..... 222/179, 180, 173, 182, 222/153, 186, 183, 154, 158, 159, 156; 248/309 R, 311.2, 312, 542, 544, 224.3, 224.4

[56] References Cited

U.S. PATENT DOCUMENTS

| | | | |
|---|---|---|---|
| 2,628,744 | 2/1953 | Mowbray | 222/179 |
| 2,665,825 | 1/1954 | Poitras et al. | 222/179 X |
| 3,150,800 | 9/1964 | Weber | 222/180 X |
| 3,182,337 | 5/1965 | Price | 222/180 X |
| 3,459,343 | 8/1969 | Rasmussen | 222/156 X |

*Primary Examiner*—Joseph J. Rolla
*Assistant Examiner*—David H. Bollinger
*Attorney, Agent, or Firm*—Woodard, Weikart, Emhardt & Naughton

[57] ABSTRACT

A support housing for a fluid-dispensing container that includes a pump for delivery of the fluid from the container. The container has a specifically contoured D-shaped neck portion flange which mounts to the support housing which has a receiving flange adapted to hold the neck portion flange. The housing also includes a front housing portion that is deformable and able to snap on and off of a back housing portion.

2 Claims, 13 Drawing Figures

FLUID-DISPENSING APPARATUS

CROSS-REFERENCE TO RELATED APPLICATIONS

This application is a continuation-in-part application of our co-pending patent application Ser. No. 402,166 filed July 26, 1982 now abandoned.

BACKGROUND OF THE INVENTION

This invention relates in general to fluid-dispensing mechanisms and, more particularly, to the design of a support housing for a soap or lotion-dispensing container which as one option is controlled by a foot pump.

Support housings are generally provided for fluid-dispensing containers so that the container can be placed in the housing and then mounted to a surface such as a wall. The fluid dispensing containers are of various sizes and shapes and contain various forms of fluid. The housings also are various sizes and shapes and there are various methods employed for securing the containers to the housings.

One method of securing the container to a housing is to use a container which has a screw-thread bottleneck which is screwed into a receiving threaded portion of the housing. This approach can sometimes cause problems because the container needs to be axially rotated and with various thread pitches and starting points, the final orientation of the container cannot be guaranteed to point in a certain selected direction. Further, other means of securing a container to a housing tend to be cumbersome or difficult to use and/or assemble. There exists a further problem when a disposable pump is used for pumping the fluid from the fluid-dispensing container. In such circumstances, a means is needed for attaching this pump to the container. If the bottleneck of the container, which has the screw threads, is used to attach the container to the housing, there is no place where the disposable pump can be easily and securely attached to this container.

A first embodiment of the present invention provides for a simple and inexpensive support housing for a fluid-dispensing container which can be easily mounted to a surface such as a wall. The first embodiment provides features for securely mounting a fluid container to the housing in a manner which is easy and simple. Further, the first embodiment allows for the use of a container which includes a disposable fluid pump which is connected to the container and attached to the screw threads of the bottleneck of the container. The first embodiment also provides a new and improved means for securing the fluid container and its disposal pump in place. These means are easy to use and simple to assemble. In contrast, prior references disclose only complicated and/or insecure methods for retaining such containers in a suitable housing.

In a second embodiment of the present invention, the basic fluid dispensing concept of the first embodiment is incorporated into a surgical unit having an elongated spout and foot pump. The simple and inexpensive nature of the first embodiment and its various features are carried through to the second embodiment, the primary differences being the addition of the foot pump and those structural changes required to incorporate the vinyl connecting hose from the foot pump to the pumping mechanism coupled to the fluid-dispensing container.

It is also desirable that the support housing of both embodiments be designed so that they can receive only the types of fluid-dispensing containers which they purport to house. In this way the person using the fluid dispenser can be assured that the fluid dispensing container disposed within the support housing contains the type of fluid that he expects. The present invention provides a support housing which includes a unique mounting means for a fluid container which has a specifically adapted and contoured neck portion. This allows the support housing to accept only those types of fluid containers that include such a contoured neck portion. This is important, for example, where these types of containers are used for hand washing where proper hygiene is very important. In hospitals, for example, the hand washing fluids contained within these fluid-dispensing containers have to be fluids which are designed to provide the utmost in cleaning and disinfection. Therefore, any mix-up in fluids could be a problem, and such problems are minimized by the present invention.

The present invention provides for a support housing which is designed to only mate with a certain type of fluid-dispensing container. Therefore, this insures the user that the housing will only house fluid containers containing the fluid he needs and expects. A further feature of the present invention is the presence of a central opening in the housing front. This opening is sized and positioned so that the user is provided a visual indication of the container and its contents.

A support housing for a fluid dispensing container which is used in specific areas needs to be simple and easily taken apart so that it can be easily cleaned and reloaded with a fresh supply of solution. In hospital environments, for example, these types of containers will often be found in scrub areas outside of surgery. Such containers cannot afford to become contaminated and by providing a device that can be easily disassembled and cleaned, contamination is minimized.

There are numerous devices which have been patented for fluid-dispensing containers but none of these provide the advantages and the ease of use and the simple features of the present invention. Also none of these prior patents provide for a container which can be attached to the support housing and still have its disposable pump attached around the screw threads of the bottleneck. Further none of these prior-patented devices provide for a support housing which will only accept a certain type of container which has a uniquely contoured neck portion. Examples of prior patents are the following:

| Patent No. | Patentee |
|---|---|
| 3,858,762 | Meshberg |
| 3,182,337 | Price |
| 3,334,791 | Metzler |
| 2,198,811 | Gabriel |
| 650,166 | Chadbourn |
| 3,349,967 | Schneller |
| 2,652,952 | Mowbray |
| 3,045,873 | Ryan |
| 2,583,867 | Dobkin |

Dobkin discloses a liquid soap dispenser and features a nondisposable pump which is part of the housing. Dobkin does not have a unique means of attaching the fluid-dispensing container to the housing. Ryan discloses a housing for an aerosol bomb. The housing is specifically designed for the use of an aerosol bomb and does not have any specific features for uniquely mounting the fluid container.

Mowbray discloses a liquid soap dispenser which is intended to be used with only one type of container. However, Mowbray does not allow for a disposable pump to be attached to the container. Mowbray uses the threads of the bottleneck portion of the container to attach the container to the housing.

Schneller discloses a rack for containing various toiletry dispensers. There does not appear to be a disposable pump, and the containers are completely enclosed. Further, the container of Schneller is difficult to take apart and difficult to assemble and the containers are threadedly mounted by their bottleneck portion to the housing. Schneller does not disclose a container which requires a unique bottle shape with a unique bottleneck portion.

Chadbourn discloses a pneumatic syrup jar for soda fountains, but again, Chadbourn is mounted by taking advantages of the threads on the bottleneck portion and is not adapted for receipt of unique types of bottles. Gabriel discloses a coin-operated liquid dispenser which discloses the concept of mounting the bottle by using the threads of the bottleneck.

Metzler discloses a simple device which again is for a fluid dispenser, but again, the bottle is mounted by its bottleneck portion and there is no provision for a disposable fluid pump nor is there provision for using uniquely shaped bottles with the device.

Price shows a flush tank attachment for lever operation of atomizer deodorant cans. The device shows a method for mounting a can but does not show a method for mounting a specifically contoured container which has a specially contoured neck portion. Further, there is no means shown in Price for securing the cans so that they are held in the bracket securely. Finally, the Price invention does not show any way to insure that only certain types of cans would be fitted to the support housing. Meshberg discloses an actuator assembly for an encased dispenser. The valve stem of the container is assembled to a spray button which is acted upon by actuator means.

None of the foregoing patents discloses a device such as the present invention which provides a support housing for a fluid container wherein the support housing is constructed so as to receive a fluid container with a specifically contoured neck portion. Further, none of the patented devices discloses a support housing for a fluid dispensing container which is as simple and as easy to use as the present invention. Also none of the prior patents known to exist disclose the particular feature of this invention for insuring that only specific types of fluid containers, with the disposable pump attached to the bottleneck screw threads, are used with the support housing. Finally, none of the prior patents, known to exist disclose the above concepts and features in combination with a remotely located, but directly connected foot pump.

SUMMARY OF THE INVENTION

A support housing for a fluid-dispensing container according to one embodiment of the present invention comprises a housing adapted for mounting to a surface and a fluid-dispensing container which has a neck portion specifically contoured for receipt by the housing wherein the housing includes a back housing portion having a receptacle arranged to receive the contoured neck portion of the fluid-dispensing container, front housing means for holding the neck portion in the receptacle, and surface mounting means for mounting the housing to a surface.

It is an object of this invention to provide an improved support housing for a fluid-dispensing container wherein the fluid-dispensing container is securely and easily assembled to the housing.

It is another object of this invention to provide an improved support housing for a fluid-dispensing container wherein the housing is adapted to house a container which has a specifically contoured neck portion.

It is another object of the present invention to provide a fluid-dispensing mechanism which is operable to dispense a portion of a container's contents by manual activation of a remotely located foot pump.

Related objects and advantages of the present invention will be apparent from the following description.

DESCRIPTION OF THE PREFERRED EMBODIMENT

Figure 1:
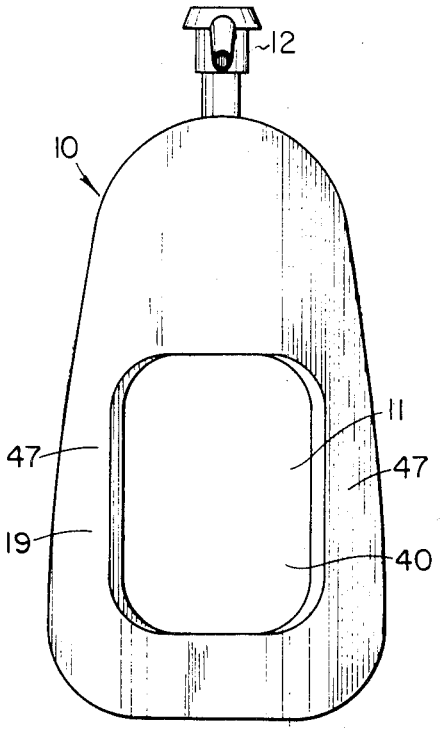
FIG. 1 is a front elevation assembly view of a support housing, a fluid-dispensing container and disposable pump according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
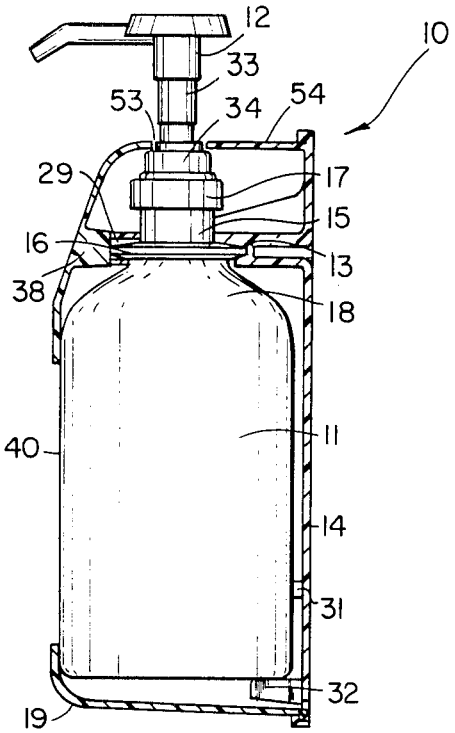
FIG. 2 is a side elevation section view of the FIG. 1 assembly.
Figure 3:
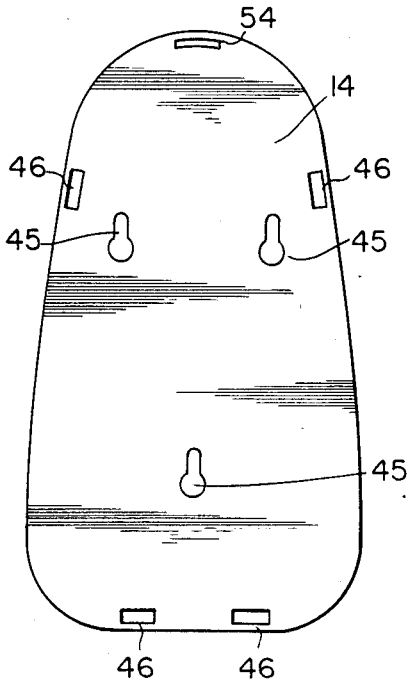
FIG. 3 is a back elevation view of the support housing of the FIG. 1 assembly.

Referring to FIGS. 1 and 2 there is illustrated a support housing 10 for fluid-dispensing container 11 that is fitted with a pump 12. In the FIGS. 1 and 2 illustrations, the container 11 is shown mounted within the housing 10. Support housing 10 includes front housing portion 19 and back housing portion 14 which is arranged to receive the contoured neck portion 15 of the container which includes a D-shaped flange 16 (see FIG. 5). The back housing portion 14 has a flange sleeve 13 (see FIGS. 4 and 6) which receives flange 16 when the container is assembled into the housing.

Figure 5:
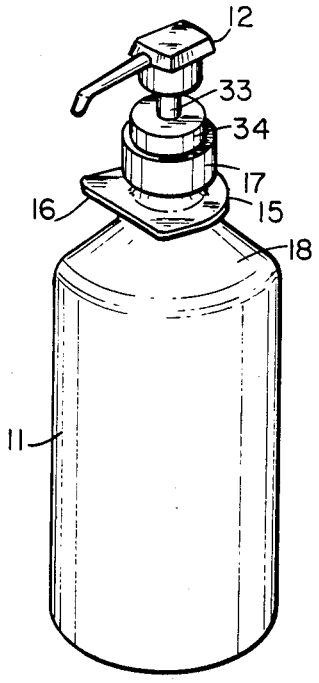
FIG. 5 is a perspective view of the fluid-dispensing container and disposable pump of the FIG. 1 assembly.
Figure 6:
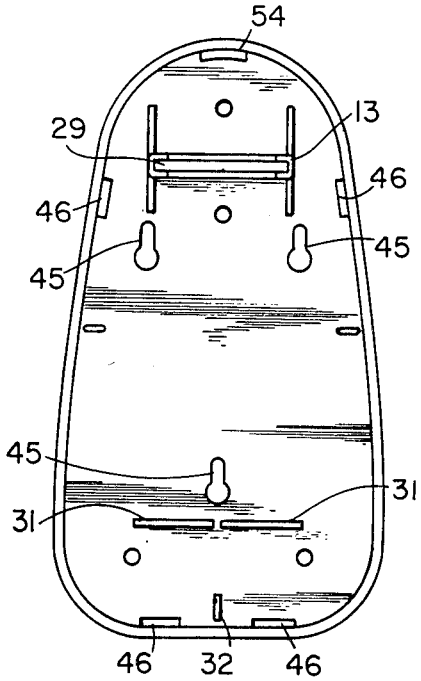
FIG. 6 is a front elevation view of a back housing portion comprising a portion of the FIG. 1 support housing.
Figure 8:
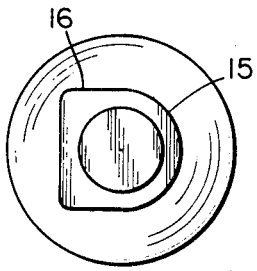
FIG. 8 is a partial, top plan view of the neck portion of the FIG. 1 container.

As is shown in FIG. 5, the contoured neck portion 15 is that portion of the container above the container body 18 and below the bottleneck threads 17. Pump 12 is threaded to the bottleneck threads 17 of the container 11, and is designed to pump out of the container a measured amount of fluid every time its top portion is depressed downwardly.

The flange sleeve 13 has a generally U-shaped opening 21 and a flange sleeve groove 29 so that once the D-shaped flange 16 slides into place its outer edge is received by the groove and the container is supported in a vertical and upright orientation. The D-shaped flange cannot rotate about its axis because it is restrained by the U-shaped sides of flange sleeve 13. In this manner, only a fluid container such as fluid container 11 that has a neck portion with a D-shaped neck flange contoured about the neck portion will be securely received by flange sleeve 13. Thus the container can be securely received and mounted to the back housing portion by sliding the D-shaped flange 16 into groove 29 of the flange sleeve 13.

The back housing portion (see FIG. 6) includes back support ridges 31 and a bottom support ridge 32 for aiding in maintaining the container in its proper orientation. However, it is to be noted while these support ridges are desirable, they are not absolutely necessary because the bottle will still remain in its desired vertical and upright orientation because of the fit between the D-shaped flange and the flange sleeve of the back housing portion.

The support housing is made by molding an inexpensive plastic and thus the entire device is low cost. Further, because the flange sleeve 13 can be made in a variety of shapes or forms to adapt to a compatibly contoured neck portion of a container, the container's neck portion can be altered in various ways and the flange can be altered in various ways so that only certain containers with certain types of contoured neck portions will fit with certain back housing flanges. Thus, according to the teachings of the present invention, it can be insured that only certain containers can be used with certain styled back housing portions. The present invention insures for the person using the fluid-dispensing container that the container contains an approved fluid. This is especially important in hospitals and related environments where it is important that the soap that is used be of a type that will properly disinfect the hands or other items that are being washed. In some situations, the container for soap and the container for hand lotion could each have a D-flange thus allowing a more universal or interchangeable design. However, the containers and flanges can just as easily be contoured for only a one-to-one utilization thus guaranteeing that only one solution could ever be present in a particular housing.

Further it is to be noted that the disposable pump 12 is attached to the container 11 by use of the bottleneck threads 17. Because the container, unlike the prior art, is mounted by its contoured neck portion 15 and not by its bottleneck threads, the disposable pump can be easily removed or attached and no special provisions need be made for it other than a slot in the housing. Also, the pump can be pointed in any direction because the pump head 33 rotates in the pump body 34.

Figure 4:
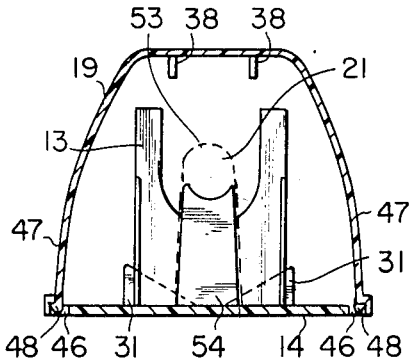
FIG. 4 is a fragmentary, top plan view of the FIG. 1 support housing.
Figure 7:
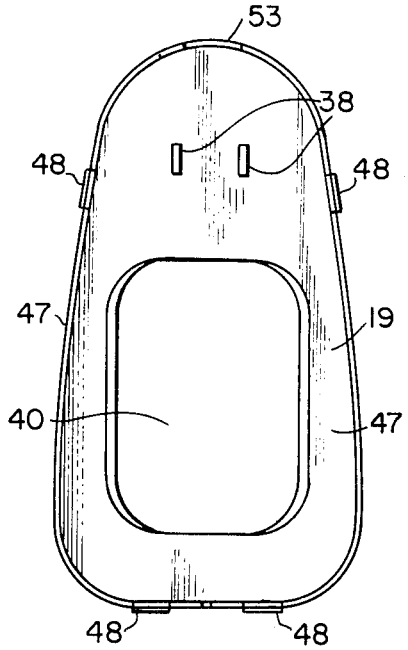
FIG. 7 is a back elevation view of a front housing portion comprising a portion of the FIG. 1 support housing.

Front housing portion 19 is designed for holding the contoured neck portion 15 of the container 11 within the flange sleeve 13. In the preferred embodiment this is accomplished by the proximity of the front surface of housing portion 19 to sleeve 13. This front housing portion 19 includes front locking ridges 38 (see FIG. 7) which as can be seen in FIG. 4 close off the flange sleeve 13 and the flange sleeve groove 29 so that the D-shaped flange cannot be pulled out of the flange sleeve. The entire assembly is held in place because the front housing portion 19 is secured to the back housing portion 14. In the preferred embodiment, this is accomplished by attachment means which are designed for detachably mounting the front housing portion to the back housing portion. The front housing portion 19 encloses the container completely except for the frontal viewing area opening 40 so that the frontal portion of the container can be seen. This enables the user to view the container contents through the support housing and to confirm that the proper fluid is present. The container 11 always goes into the housing the same way and because of the mating between the D-shaped flange and the flange sleeve, the front label of the container will always face forward and thus can always be viewed. In the prior art where the container was attached to its housing by its bottleneck threads, the container might not be threaded so that the front label would always show in a forward-facing means.

The attachment means for attaching the front housing portion to the back housing portion in the preferred embodiment is a group of locking slots 46 which are in the back housing portion and a group of mating locking ridges 48 which are on the front housing portion. The front housing portion has a deformable portion 47. In the preferred embodiment the front housing portion is made out of a deformable plastic. Thus the front housing portion is secured to the back housing portion by deforming the deformable portion 47 so that the front housing portion ridges 48 are pressed into the locking slots 46 of the back housing portion. When the deformable front portion 47 is undeformed, the locking ridges 48 engage with the locking slots 46 of the back housing portion. When the deformable front portion 47 is undeformed, the locking ridges 48 engage with the locking slots 46 so that there is a secure locking engagement attachment between the front housing portion and the back housing portion. The locking plate disclosed as part of the second embodiment is usable in combination with this assembly concept to lock the front housing portion in place.

Finally there are surface mounting means for mounting said support housing to a surface such as a wall. In the preferred embodiment these means are simply the keyholes 45 on the back of the back housing portion. As is known in the art, this would be a simple matter of screwing a group of screws into a wall and then mounting the back housing portion by its keyholes. Then the D-shaped flange of the container 11 is simply slipped into the flange sleeve, the front housing portion is deformed and snapped onto the back housing portion, the container is securely held and the assembly is complete.

Additionally, there is provided a front housing pump slot 53 which runs from the back of the front housing to a predetermined location so that when the front housing portion is slipped over the container and snapped in place, the pump extends through that slot. A back housing pump securing blade 54 is provided to complete slot 53 as is shown in FIG. 4 so that the disposable pump is secured in place as is the entire assembly.

Figure 9:
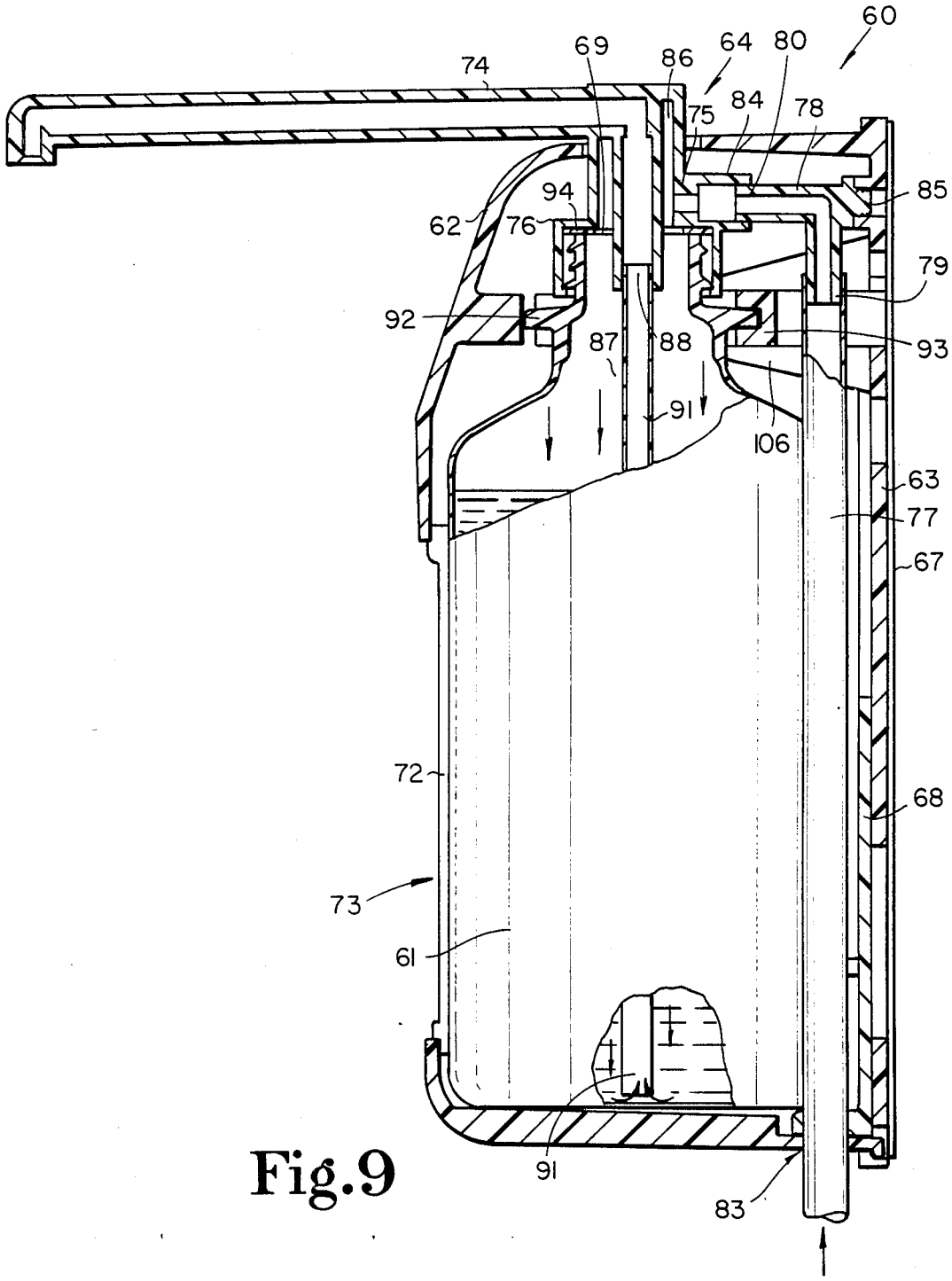
FIG. 9 is a side elevation view in full section of a fluid-dispensing mechanism according to a typical embodiment of the present invention.

Referring to FIG. 9 there is illustrated in side elevation and full section form a second preferred embodiment of the present invention. Fluid-dispensing apparatus 60, while similar in numerous respects to the combination of housing 10, container 11 and pump 12, is also different in several significant ways. Due to the similarity in design, construction and function between these two embodiments, only the differences will be described in detail hereinafter. It is to be understood as to those facets which are similar between the two embodiments as to design and construction, this similarity is intended to indicate a similarity of use and function.

Fluid-dispensing apparatus 60 includes in its complete and fully assembled composition, a fluid container 61, front housing portion 62, back housing portion 63, and pumping mechanism 64. Back housing portion 63 is assembled in combination with additional features not previously described with regard to the first embodiment of the present invention. One such feature involves a foam backing layer 67 which extends for substantially the full height as well as width of the back housing portion in order to provide both a cushioned support for the housing against a vertical surface as well as assuring a secure retention regardless of a slight unevenness or irregularities in the vertical wall to which apparatus 60 is attached. On the opposite side of the back wall portion of the back housing portion 63 is a locking plate 68 which includes an interlocking feature at its lower end and abutment arms at its uppermost end.

An additional feature of apparatus 60 is the presence of a front-facing cover or lens 72 which is heat staked at a plurality of points around its periphery so as to cover window opening 73. As will be recalled from the prior description of the first embodiment, this window opening was left open although the lens disclosed in FIG. 9 in combination with apparatus 60 could equally well be applied to the construction of the prior embodiment.

Pumping mechanism 64 includes an elongated spout 74, a pump body 75 and a connecting cap 76. A vinyl hose 77 is coupled to a connecting elbow 78 which provides a coupling location at end 79 for one end of vinyl hose 77 while the opposite end 80 installs into pump body 75.

As is intended to be understood from the FIG. 9 illustration, vinyl hose 77 extends downwardly through the interior of the housing which is formed by the combination of front housing portion 62 and back housing portion 63. This vinyl hose exits at location 83 and from that point extends to a remotely positioned foot pump whose design and operation will be described hereinafter. What is important to understand at this point is that the manual activation of the foot pump results in sending a pulse of air upwardly through the vinyl hose and into the connecting elbow 78. By maintaining air-tight connections and fittings at each point between the foot pump and the interior of container 61, it should be appreciated that the pressure provided by this pulse of air from the foot pump, once introduced into the interior of container 61, results in forcing a portion of the liquid contents of the container up and out through spout 74.

As should be understood, connecting elbow 78 provides a right-angle turn so as to connect the vertically extending vinyl hose with the horizontal inlet 84 of pump body 75. A corner projection 85 of the connecting elbow is utilized for secure attachment of the elbow to the back housing portion 63 of apparatus 60. As is illustrated, the connecting elbow 78 includes an interior hollow passageway extending the full length of the elbow and this passageway in turn communicates with a central clearance passageway in inlet 84. In turn, the passageway of inlet 84 is in open communication with annular chamber 86 as well as the interior 87 of container 61. Although annular chamber 86 is concentric with spout inlet portion 88, the upper end of chamber 86 is closed such that any entering air, via the remotely located foot pump, is ultimately forced into the interior 87 of container 61.

Due to the fact that the spout 74, pump body 75, connecting cap 76 and inlet 84 are of a molded, homogeneous and unitary construction, there is no opening or other leakage permitted except at the exiting open end of spout 74. Once connecting cap 76 is securely seated and sealed against the top opening 69 of container 61, the entering air which pushes downwardly on the top surface of any liquid within the container results in forcing that liquid up and out through spout 74. Consequently, for each stream or pulse of air which is delivered through hose 77, a metered amount of liquid will be dispensed from spout 74. Clearly, the larger the pulse of air which is received and the more rapidly a chain of pulses are received, the greater the amount of liquid which is pushed out through spout 74. In this manner, a user of apparatus 60 can govern the amount of liquid which he wishes to receive from the outlet of the spout as well as the rate at which this liquid will be received. Control of this is solely by means of the remotely located foot pump whose operation will be described hereinafter.

As is well known in the art and is to be understood from the illustration and descriptions provided, the entering pulses of air enter a sealed chamber thereby increasing the pressure in the zone or area directly above the top surface of the liquid level within the container. By means of plastic extension tube 91, which is press-fit into spout inlet portion 88 and extends from that location to a location adjacent the bottom surface of the container, the increase in air pressure entering the zone above the liquid contents of the container forces the liquid in a downwardly direction and as a result, pushes liquid up through extension tube 91 into spout inlet portion 88 and into the outlet of spout 74. Connecting cap 76 assembles to the outlet of container 61 by means of a snap-fit receipt by means of an inwardly directed flange edge which is annular in shape and surrounds the interior surface of the lower edge of the cap. This flange edge is received by an outwardly projecting annular lip portion on the container neck that is disposed beneath the exterior threads on the container neck and above the D-shaped flange 92 which is received by flange sleeve 93. The assembly of the connecting cap to the container and thus the assembly of the pump is quick and efficient and is completed by merely a forced assembly which snaps together thereafter securely retaining the connecting cap over the open mouth of the container and around the container's external threads. A further feature which results in an enclosed air chamber disposed above the liquid contents of the container is the presence of a foam gasket 94 which is of an annular ring shape and secured to the upper portion of the connecting cap such that when the cap is snapped onto the container neck, the foam gasket is compressed tightly against the top rim of the container mouth thereby sealing in an air-tight fashion the connection between the interior contents of the container and the spout.

Figure 10:
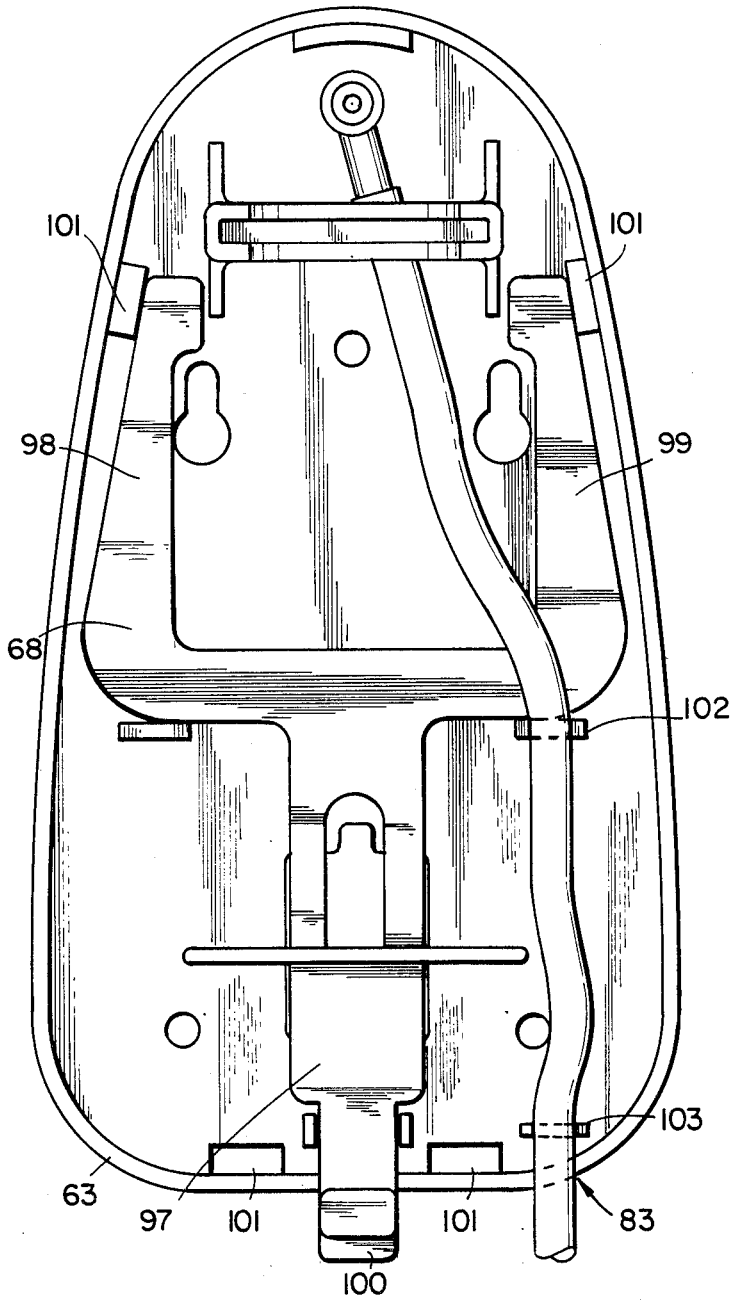
FIG. 10 is a front elevation view in full section of the back housing portion of the FIG. 9 mechanism.
Figure 11:
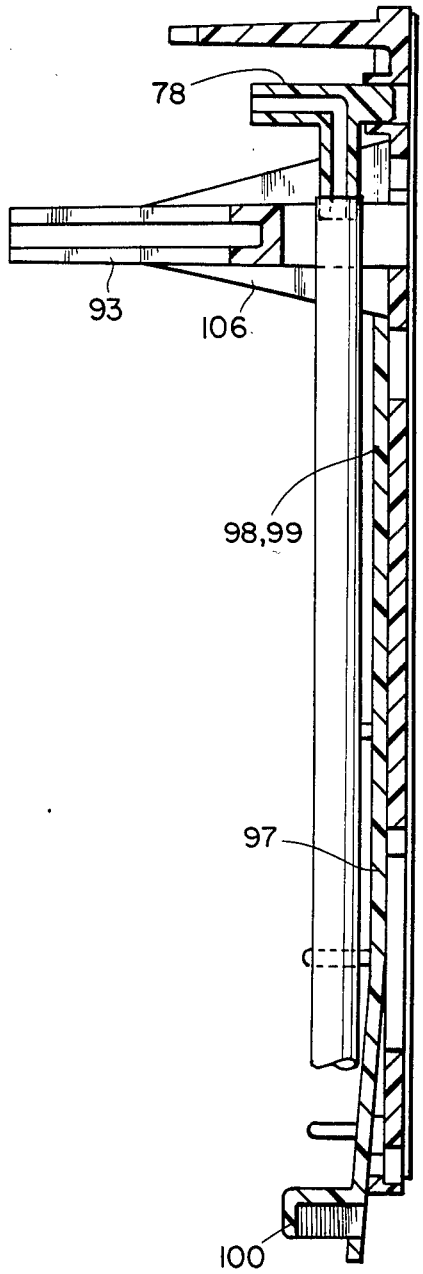
FIG. 11 is a side elevation view in full section of the FIG. 10 back housing portion.

Referring to FIGS. 10 and 11, there are illustrated additional features of the present invention which although included in the FIG. 9 illustration are more easily visualized by the FIG. 10 and FIG. 11 illustrations.

In FIG. 10, what is disclosed is the construction of the back housing portion as viewed in front elevation form with the front housing portion and the container removed. Due to the fact that this particular back housing portion 63 is very similar to that already disclosed and discussed with regard to the first embodiment of the present invention, only those features which are of particular additional novelty or in some manner different than what has already been described will be discussed herein. One feature which is usable with either the construction of the first embodiment of the present invention or with this embodiment is the presence of a locking plate 68 which has a Y-shaped or yoke configuration includes a handle portion 97 and two oppositely disposed arms 98 and 99. As should be understood from the FIG. 10 and FIG. 11 illustrations, locking plate 68 is oriented in an unlocked condition. This is evidenced by lower locking portion 100 being in an extended orientation below the bottom edge of the back housing portion. From the side elevation and full section view of FIG. 11, it should be understood that this locking portion is configured in such a manner such that with the front housing portion attached to the back housing portion and the locking plate in this unlocked condition, upward pressure on locking portion 100 forces the entire locking plate in an upward direction and results in the locking portion 100 snapping into a combination fit at the lower rear edge of the front housing portion and back housing portion as is illustrated in FIG. 9.

The locking concept by utilization of locking plate 68 is accomplished in part by the fact that for the front housing portion to snap into an assembled combination with the back housing portion, the front housing portion must be inwardly compressed so that its mating locking ridges are able to snap into locking slots 101, in virtually the same manner as previously described for locking slots 46 and locking ridges 48. Once the front housing portion is snapped into its assembled combination with the back housing portion, upward pressure on locking portion 100 causes the Y-shaped configuration of plate 68 as it pushes upwardly to also push outwardly against the wall of the front housing portion 62. This is best illustrated by the fact that arms 98 and 99 diverge outwardly as they extend downwardly in the direction of handle 97. Consequently, as they are pushed upwardly and are restricted from moving inwardly by support flanges 106 which support flange sleeve 93, the only means to accommodate the increasing width across the outer edges of arms 98 and 99, as this upward motion continues, is for the arms themselves to be compressed inwardly thus applying a greater outwardly directed force toward the side wall of the front housing portion which has been snapped into locking slots 101. This upward force and increasing pressure continues until such time as locking portion 100 arrives at its interlocked position at the lower rear edge of the front housing portion and back housing portion assembly.

Figure 12:
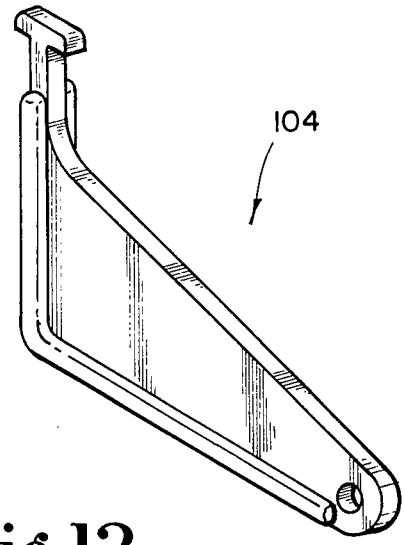
FIG. 12 is a perspective view of a lock plate key comprising an accessory for the FIG. 9 mechanism.

Referring to FIG. 12, a release key is illustrated which is designed to engage the locking portion of the locking plate so as to lower it out of its force-fit engagement against the sides of the front housing portion thereafter allowing the front housing portion to be compressed for disassembly and thereafter change the contents of the container. Without such a release key, it is virtually impossible to pull the locking plate downwardly in order to allow this release, and unless the plate is so moved in a downwardly direction, it is not possible without damage or other destruction to compress the side walls of the front housing portion so as to take it out of locked engagement with locking slots 101. In this manner a fully inserted locking plate serves to lock the front and back housing portions together.

Also illustrated in FIG. 10 is the fact that vinyl hose 77 is retained in its orientation from its point of connection to connecting elbow 78 downwardly along the side of the container and out through an opening at location 83 in the bottom of the front housing portion and back housing portion. As is illustrated, connecting elbow 78 is rotated slightly off of vertical so as to begin the orientation of vinyl hose 77 at a slight angle. To retain the hose in its desired orientation within the front and back housing portions, two clips 102 and 103 are provided into which the vinyl hose may be easily depressed without undue contraction or restriction allowing it to be held in its desired orientation without reducing its cross-sectional area to any appreciable degree that might interfere with the pumping of air through the hose.

It is to be understood that locking plate 68 is equally usable with either embodiment of the present invention. It is described as part of those figures relating primarily to the second embodiment, but it should be understood that due to the large number of similarities and in fact identities between the front and back housing portions of the two embodiments, the addition of locking plate 68 to the first embodiment is an addition which can be easily made. Since its function is unaffected by the style of pumping mechanism, manual or foot-operated, those facets of the present invention which primarily distinguish the first embodiment from the second, do not affect the addition of the locking plate and its utilization to lock the front housing portion to the back housing portion when the dispensing apparatus in use.

Figure 13:
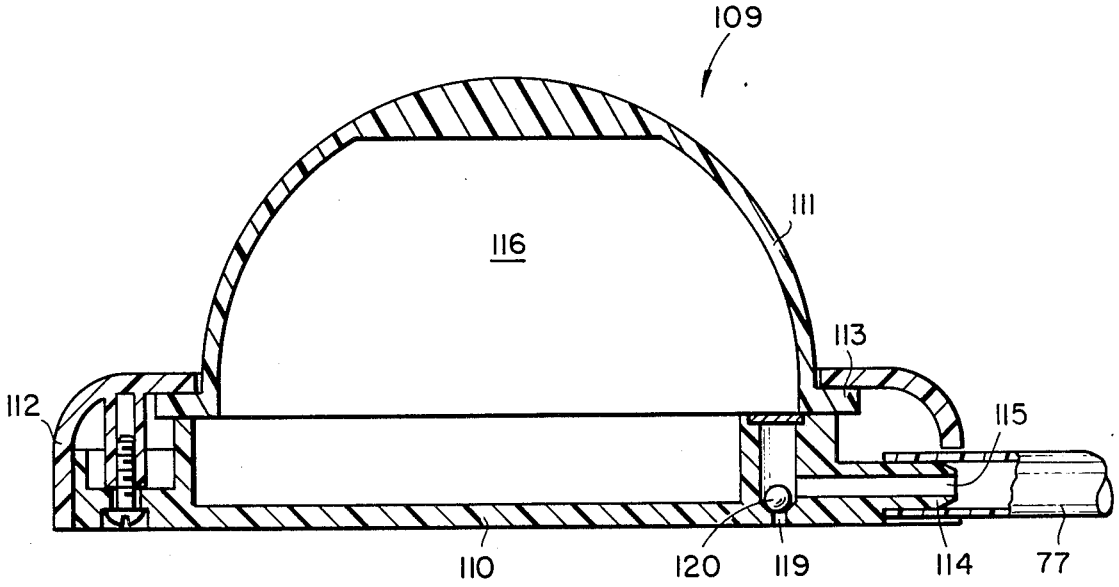
FIG. 13 is a side elevation in full section of a foot pump comprising a portion of the FIG. 9 mechanism.

Referring to FIG. 13, foot pump 109 is illustrated in greater detail by means of a side elevation view in full section. Foot pump 109 includes as basic component parts base 110, deformable cover 111 and surrounding retainer 112 which provides a type of clamping action to retain cover 111 in position over base 110. As is illustrated, threaded fasteners are utilized to secure base 110 to retainer 112 thereby sandwiching and clamping cover flange 113 in position. As is intended to be illustrated, though not necessarily fully described by the full section view of FIG. 13, cover 111 is a dome-edged structure, part-spherical in nature while base 110 and retainer 112 are of annular shape. Vinyl hose 77 couples to foot pump 109 by means of tube 114 whose hollow interior passageway 115 communicates directly with the hollow interior 116 of the foot pump. By creating a sealed configuration by the clamping action around the flange of cover 111, and by providing a single outlet through passageway 115, it is to be understood that by deforming cover 111, the volume of air contained within interior cavity 116 is reduced by pushing a portion of the air up through passageway 115 and in turn through hose 77 and on up to pumping mechanism 64 as has been previously disclosed and described.

In order to renew the air supply within interior cavity 116, a one-way valve construction is provided by means of inlet 119 and floating ball 120. When cover 111 is deformed by applying pressure by one's foot, the air within interior cavity 116 is pushed out through passageway 115 and at the same time pushes against ball 120 thereby sealing closed inlet 119. However, when the deforming pressure on the outer surface of cover 111 is released, the resiliency of the polyurethane material used for the cover returns the cover to its original dome-like shape thereby creating a vacuum or suction force sufficient in magnitude to lift upwardly on ball 120 thereby allowing a fresh supply of air to enter through inlet 119. Entry of air through inlet 119 represents the path of least resistance for the pressure differential between the interior cavity 116 and the outside atmosphere to be satisfied. Consequently, there is no effect as to the air pressure existing within the sealed compartment of container 61 and pumping mechanism 64. Consequently, there is a renewed air supply for the interior cavity 116 on an almost instant basis thereby allowing the user of fluid-dispensing apparatus 60 to again by means of his foot compress or deform cover 111 sending another pulse of air through vinyl hose 77. As previously indicated, this procedure can be repeated over and over again and in rapid succession thereby forcing a pulsating stream of the liquid contents from container 61 out through spout 74.

Both the front housing portion as well as the back housing portion, the locking plate, and the pumping mechanism (excluding connecting elbow 78) are of a molded plastic construction with each piece being of a homogenous and unitary configuration. This particular aspect of the construction contributes to its low cost, reliability and suitability for its intended purpose.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A support housing for a fluid-dispensing container, said support housing being adapted for mounting to a surface and for housing said fluid-dispensing container, said fluid-dispensing container having a neck portion specifically contoured for receipt by said housing, said support housing comprising:

a back housing portion having a means for receiving the contoured neck portion of said container;

a front housing portion adapted for holding said neck portion within said receiving means;

surface mounting means for mounting said housing to a surface; and a locking plate having abutment arms and being movable relative to said back housing portion between a locked orientation and an unlocked orientation, in said locked orientation said arms being contiguous with said front housing portion.

2. A fluid-dispensing apparatus for pumping from a container a portion of the container contents, said fluid-dispensing apparatus comprising:

a two-part, snap-together housing including a flange sleeve;

a container having an open mouth and a contoured flange slidably received by said flange sleeve;

a pump mechanism sealed onto said open mouth and operable in response to air pressure to deliver a portion of said container contents;

a foot pump operably coupled to said pump mechanism for delivering pulses of air to said pump mechanism by foot activation of said foot pump; and a locking plate having abutment arms and being movable relative to said housing between a locked orientation and an unlocked orientation, in said locked orientation said arms being operable to preclude manual unsnapping of said two housing parts.

* * * * *